US006449796B1

(12) United States Patent
Severino

(10) Patent No.: US 6,449,796 B1
(45) Date of Patent: Sep. 17, 2002

(54) WALL MOUNTABLE RAZOR CLEANING DEVICE

(76) Inventor: Sheri E. Severino, 161 W. 19th St., Huntington Station, NY (US) 11746

( * ) Notice: Subject to any disclaimer, the term of this patent is extended or adjusted under 35 U.S.C. 154(b) by 41 days.

(21) Appl. No.: 09/735,051

(22) Filed: Dec. 13, 2000

(51) Int. Cl.[7] ..... A47L 25/00; A45D 27/24
(52) U.S. Cl. ..... 15/218; 15/210.1; 206/354
(58) Field of Search ..... 15/218, 218.1, 15/104.92, 210.1; 206/829, 354

(56) References Cited

U.S. PATENT DOCUMENTS

| | | | | |
|---|---|---|---|---|
| 836,189 | A | * | 11/1906 | Hutchinson |
| 1,144,456 | A | * | 6/1915 | Barnes |
| 1,203,903 | A | * | 11/1916 | Nystrand |
| 2,052,021 | A | * | 8/1936 | Drachman |
| 2,217,570 | A | * | 10/1940 | Stroup |
| 3,110,917 | A | * | 11/1963 | McPeek, Jr. |
| 3,464,110 | A | | 9/1969 | Anna |
| 3,973,286 | A | * | 8/1976 | Logan |
| 4,053,960 | A | * | 10/1977 | Kingswell |
| 4,054,963 | A | | 10/1977 | Taylor |
| 6,009,622 | A | | 1/2000 | Liedblad |

FOREIGN PATENT DOCUMENTS

| | | | |
|---|---|---|---|
| GB | 12447 | * | 6/1895 |
| GB | 167364 | * | 8/1921 |
| SE | 57630 | * | 10/1924 |

* cited by examiner

*Primary Examiner*—Randall E. Chin
(74) *Attorney, Agent, or Firm*—Goldstein & Lavas, P.C.

(57) ABSTRACT

A wall mountable razor cleaning device including a pad portion mounted on a rear panel. The pad portion includes a textured forward surface. The textured forward surface is capable of removing hair from a razor blade.

1 Claim, 2 Drawing Sheets

WALL MOUNTABLE RAZOR CLEANING DEVICE

BACKGROUND OF THE INVENTION

The present invention relates to a wall mountable razor cleaning device and more particularly pertains to allowing hair that has been built up within blades of the razor to be removed.

The difficult task when using disposable razors and razors having changeable blades involves the removal of hairs that become lodged within, and or between these blades. Some people become so frustrated by this task that they eventually attempt to pick these hairs out from the blades with their fingers, with the result being cuts to their fingers. What is needed is a way to remove built-up hair from within razor blades without having to resort to extreme measures.

The present invention attempts to solve the abovementioned problem by providing a textured pad that can be mounted on a shower wall or the like that the user can run the razor blade against in a direction opposite that of when shaving, in order to remove these hairs from the blade.

The use of razor cleaning accessories is known in the prior art. More specifically, razor cleaning accessories heretofore devised and utilized for the purpose of cleaning a razor are known to consist basically of familiar, expected and obvious structural configurations, notwithstanding the myriad of designs encompassed by the crowded prior art which have been developed for the fulfillment of countless objectives and requirements.

By way of example, U.S. Pat. No. 6,009,622 to Lieblad discloses a razor cleaning device comprised of a housing with a water hole for submerging the razor in water and squeezing. U.S. Pat. No. 3,464,110 to Anna and U.S. Pat. No. 4,054,963 to Taylor disclose various devices for cleaning electric razors.

While these devices fulfill their respective, particular objective and requirements, the aforementioned patents do not describe a wall mountable razor cleaning device for allowing hair that has been built up within blades of the razor to be removed.

In this respect, the wall mountable razor cleaning device according to the present invention substantially departs from the conventional concepts and designs of the prior art, and in doing so provides an apparatus primarily developed for the purpose of allowing hair that has been built up within blades of the razor to be removed.

Therefore, it can be appreciated that there exists a continuing need for a new and improved wall mountable razor cleaning device which can be used for allowing hair that has been built up within blades of the razor to be removed. In this regard, the present invention substantially fulfills this need.

SUMMARY OF THE INVENTION

In the view of the foregoing disadvantages inherent in the known types of razor cleaning accessories now present in the prior art, the present invention provides an improved wall mountable razor cleaning device. As such, the general purpose of the present invention, which will be described subsequently in greater detail, is to provide a new and improved wall mountable razor cleaning device which has all the advantages of the prior art and none of the disadvantages.

To attain this, the present invention essentially comprises a pad portion mounted on a rear panel. The pad portion includes a textured forward surface. The textured forward surface is capable of removing hair from a razor blade. A housing is coupled with respect to the pad portion. The housing has an open outer end, a closed inner end, and a surrounding side wall. The housing is dimensioned for holding a plurality of spare razor blades therein. The open upper end is hingedly coupled with the rear panel of the pad portion. The closed inner end has a plurality of suction cups disposed thereon to allow securement of the housing to a selected surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wall mountable razor cleaning device which has all the advantages of the prior art razor cleaning accessories and none of the disadvantages.

It is another object of the present invention to provide a new and improved wall mountable razor cleaning device which may be easily and efficiently manufactured and marketed.

It is a further object of the present invention to provide a new and improved wall mountable razor cleaning device which is of durable and reliable construction.

An even further object of the present invention is to provide a new and improved wall mountable razor cleaning device which is susceptible of a low cost of manufacture with regard to both materials and labor, and which accordingly is then susceptible of low prices of sale to the consuming public, thereby making such wall mountable razor cleaning device economically available to the buying public.

Even still another object of the present invention is to provide a new and improved wall mountable razor cleaning device for allowing hair that has been built up within blades of the razor to be removed.

Lastly, it is an object of the present invention to provide a new and improved wall mountable razor cleaning device including a pad portion mounted on a rear panel. The pad portion includes a textured forward surface. The textured forward surface is capable of removing hair from a razor blade.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figures 1, 2:
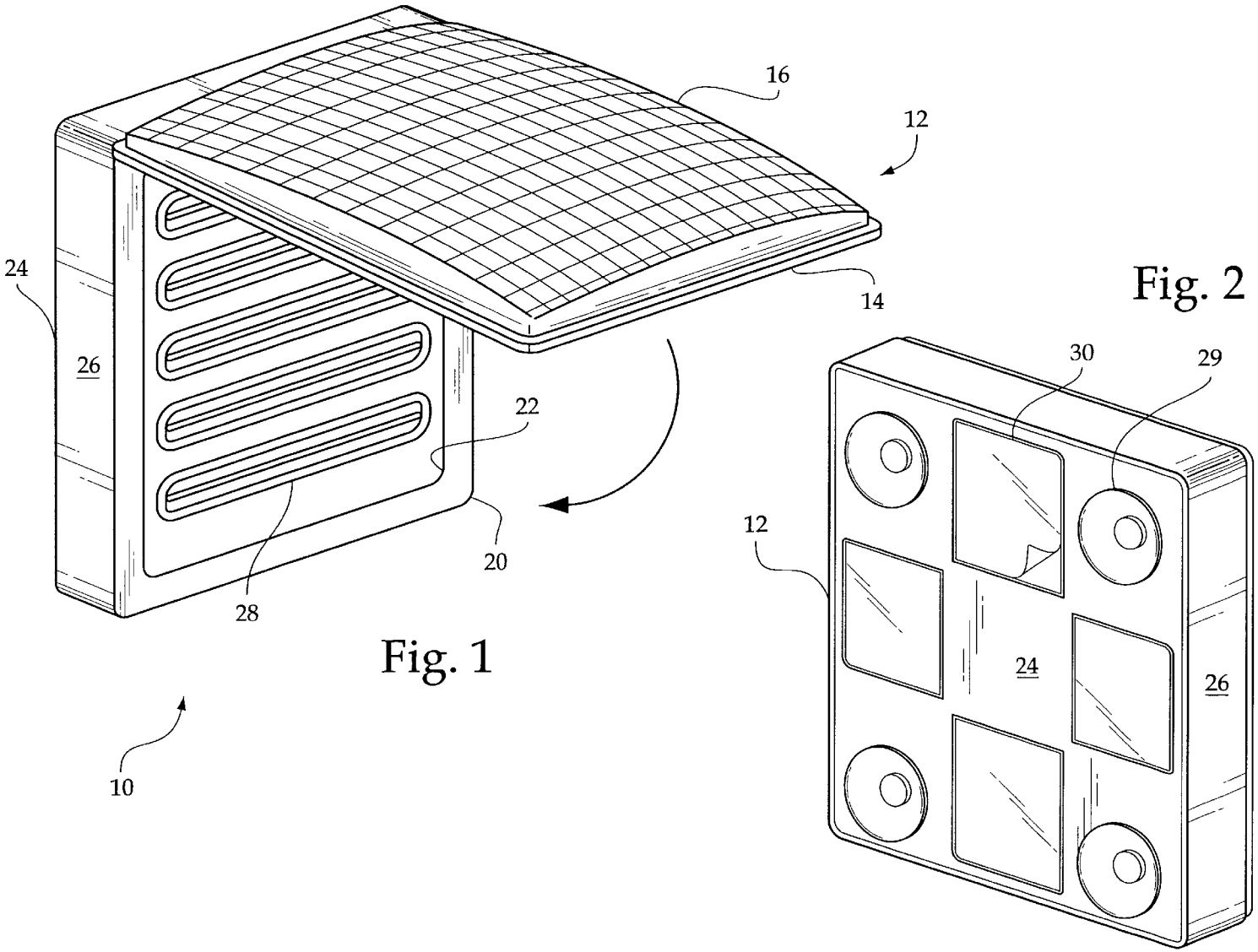
FIG. 1 is a perspective view of the preferred embodiment of the wall mountable razor cleaning device constructed in accordance with the principles of the present invention.
FIG. 2 is a rear perspective view of the present invention.
Figure 3:
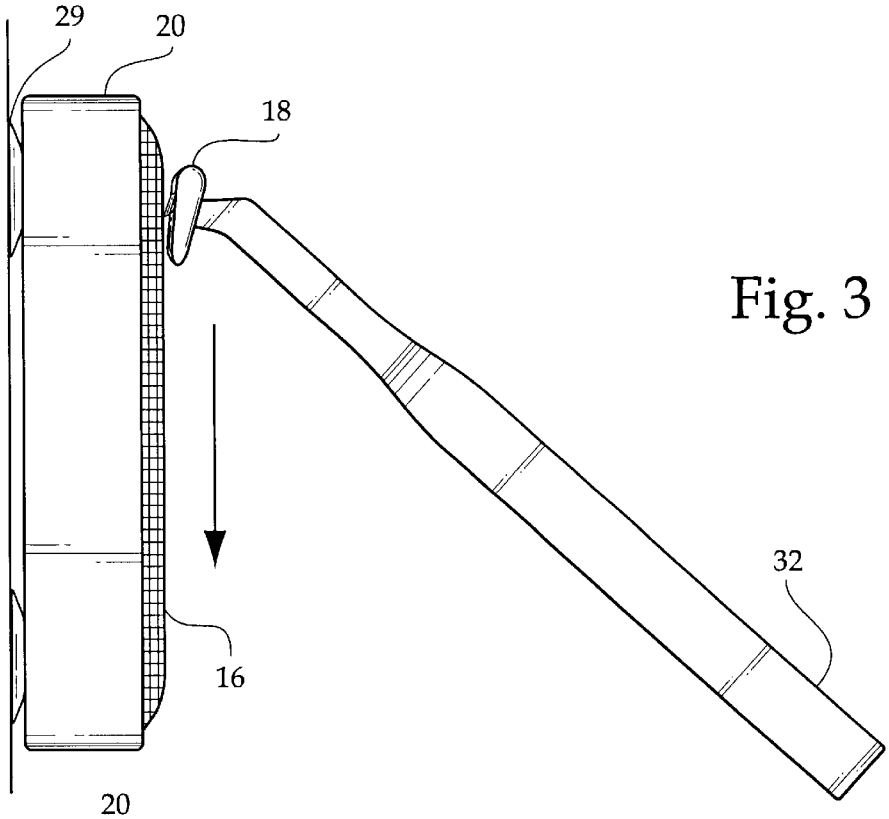
FIG. 3 is a side view of the present invention illustrated in use.
Figure 4:
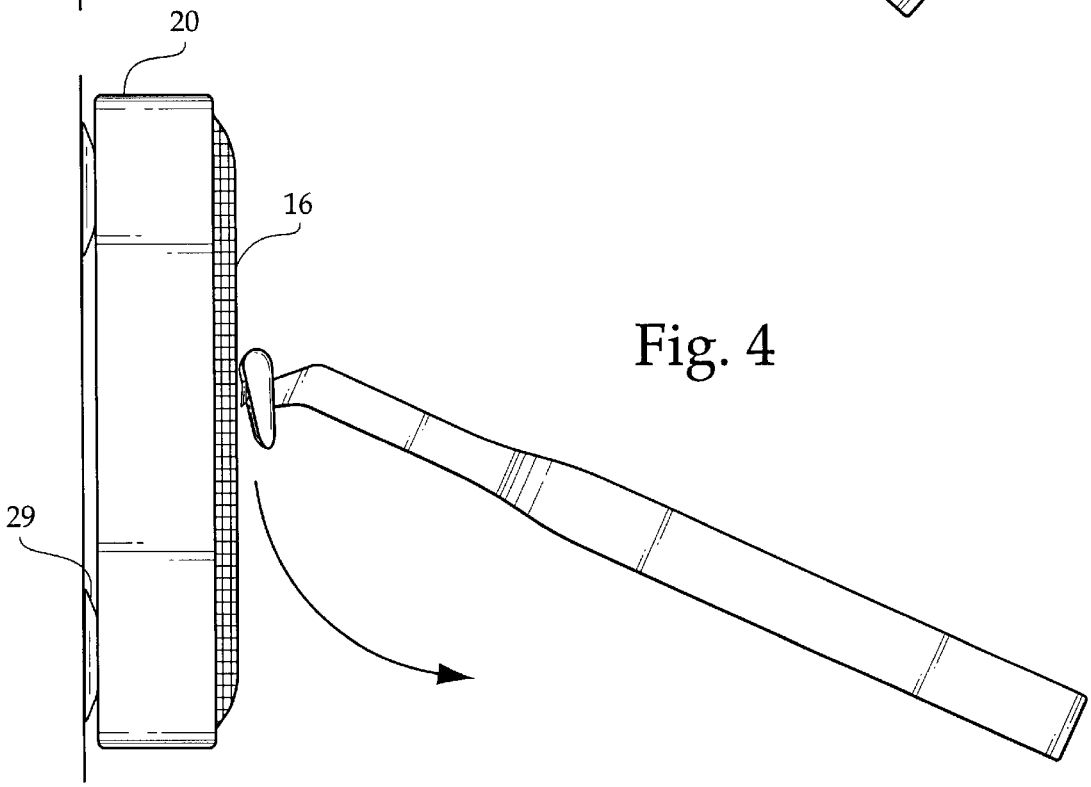
FIG. 4 is a side view of the present invention illustrated in use.

With reference now to the drawings, and in particular, to FIGS. 1 through 4 thereof, the preferred embodiment of the new and improved wall mountable razor cleaning device embodying the principles and concepts of the present invention and generally designated by the reference number 10 will be described.

Specifically, it will be noted in the various Figures that the device relates to a wall mountable razor cleaning device for allowing hair that has been built up within blades of the razor to be removed. In its broadest context, the device consists of a pad portion and a housing. Such components are individually configured and correlated with respect to each other so as to attain the desired objective.

The pad portion 12 is mounted on a rear panel 14. The pad portion 12 includes a textured forward surface 16. The textured forward surface 16 is capable of removing hair from a razor blade 18.

The housing 20 is coupled with respect to the pad portion 12. The housing 20 has an open outer end 22, a closed inner end 24, and a surrounding side wall 26. The open outer end 22 has a plurality of receptacles 23 dimensioned for holding a plurality of spare razor blades 28 therein. The open outer end 22 is hingedly coupled with the rear panel 14 of the pad portion 12. The closed inner end 24 has a plurality of suction cups 29 disposed thereon to allow securement of the housing 20 to a selected surface. Additionally, as noted in FIG. 2, the housing 20 is provided with alternate securement means, such as hook and loop fasteners 30.

In use, the shaving person will take his razor 32 and place the razor blade 18 against the textured forward surface 16 of the pad portion 12. In a stroke opposite that of the shaving stroke, the blade 18 is pressed against the textured forward surface 16 thereby removing the hair particles from the blade 18 in a manner that is more thorough than running the blade 18 under a stream of water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A wall mountable razor cleaning device for allowing hair that has been built up within blades of the razor to be removed comprising, in combination:

a pad portion mounted on a rear panel, the pad portion including a textured forward surface, the textured forward surface being capable of removing hair from a razor blade; and a housing coupled with respect to the pad portion, the housing having an open outer end, a closed inner end, and a surrounding side wall, the open outer end having a plurality of receptacles therein, said receptacles being dimensioned for holding a plurality of spare razor blades therein, the open outer end being hingedly coupled with the rear panel of the pad portion, the closed inner end having a plurality of suction cups disposed thereon to allow securement of the housing to a selected surface.

* * * * *